US007033466B2

(12) United States Patent
Riewe

(10) Patent No.: US 7,033,466 B2
(45) Date of Patent: Apr. 25, 2006

(54) ELECTROCHEMICAL STRIPPING USING SINGLE LOOP CONTROL

(75) Inventor: Curtis Heath Riewe, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 202 days.

(21) Appl. No.: 10/260,055

(22) Filed: Sep. 27, 2002

(65) Prior Publication Data

US 2004/0060827 A1 Apr. 1, 2004

(51) Int. Cl.
*C25F 7/00* (2006.01)
*C25F 3/02* (2006.01)
*C25F 3/08* (2006.01)

(52) U.S. Cl. ..... 204/229.1

(58) Field of Classification Search ..... 205/640, 205/641, 645; 204/228.1, 228.9, 229.8, 229.9, 204/230.1, 230.7, 230.8
See application file for complete search history.

(56) References Cited

U.S. PATENT DOCUMENTS

| | | | | |
|---|---|---|---|---|
| 3,886,055 A | | 5/1975 | Baboian et al. | |
| 4,227,988 A | | 10/1980 | Galwey et al. | |
| 4,261,804 A | | 4/1981 | McGivern, Jr. | |
| 4,642,172 A | | 2/1987 | Fruhwald | |
| 5,096,550 A | * | 3/1992 | Mayer et al. | 205/642 |
| 5,198,988 A | * | 3/1993 | Dorr et al. | 205/775 |
| 5,502,370 A | * | 3/1996 | Hall et al. | 323/284 |
| 5,530,361 A | * | 6/1996 | Andrieu et al. | 324/426 |
| 6,413,389 B1 | * | 7/2002 | Shih et al. | 204/229.1 |
| 6,440,291 B1 | * | 8/2002 | Henri et al. | 205/205 |
| 6,632,348 B1 | * | 10/2003 | Ahn et al. | 205/645 |
| 2003/0029726 A1 | * | 2/2003 | Kovarsky et al. | 205/81 |

FOREIGN PATENT DOCUMENTS

| | | |
|---|---|---|
| EP | 1 010 782 A1 | 6/2000 |
| EP | 1 215 306 A1 | 6/2002 |

OTHER PUBLICATIONS

"Potentiostat Primer", obtained at http://www.gamry.com/App_Notes/Potentiostat_Primer.htm, accessed on Jan. 6, 2005, published on May 20, 2004.*
"PC4 Potentiostat/Galvanostat/ZRA Operator's Manual", Jun. 1999, Gamry Instruments.*
Skoog et al, "Fundamentals of Analytical Chemistry", 1996 (no month), pub. by Saunders College Publishing, 7th Edition, pp. 313-314 and 387-389.*
"Model 2055—High-Current Potentiostat-Galvanostat", Amel Instruments, Internet document from www.amelsrl.com/pages/2055.htm, pp. 1-5.

* cited by examiner

*Primary Examiner*—Harry D Wilkins, III
(74) *Attorney, Agent, or Firm*—Bachman & LaPointe, P.C.

(57) ABSTRACT

The present invention relates to a control loop to be used in a system for stripping a coating from a part. The control loop comprises an electrometer for measuring a potential between the part and a reference electrode and generating a voltage output signal, an operational amplifier for comparing the voltage output signal to a set point voltage and for producing an output signal to be used to reduce the difference between the voltage output signal and the set point voltage, and a high current power transistors for supplying a current to the part.

14 Claims, 1 Drawing Sheet

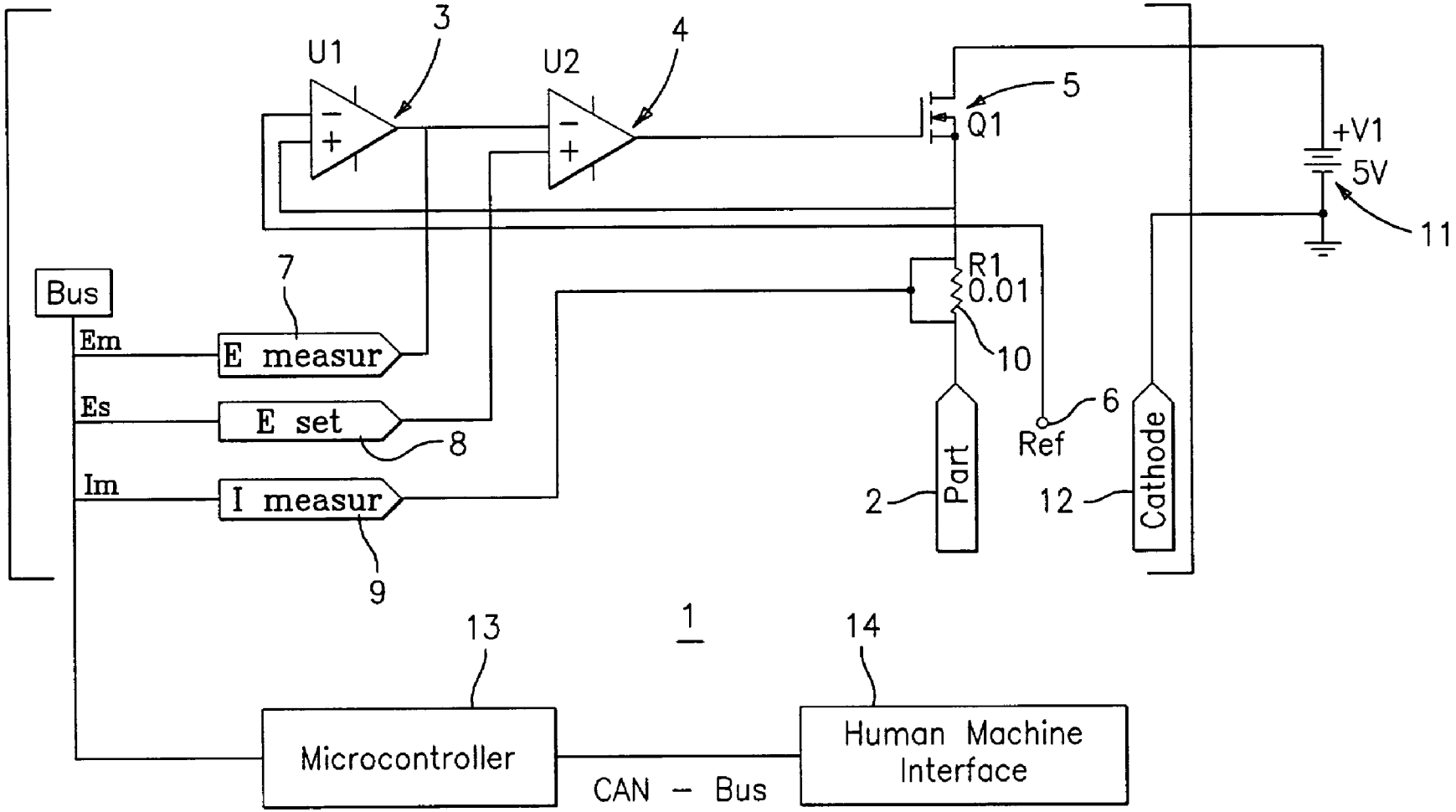
+V1
5V
11
Cathode
12
6
Ref
5
Q1
R1
0.01
10
Port
2
14
Human Machine
Interface
1
CAN - Bus
4
U2
3
U1
13
Microcontroller
8
9
7
E measur
E set
I measur
Bus
Em
Es
Im

ELECTROCHEMICAL STRIPPING USING SINGLE LOOP CONTROL

BACKGROUND OF THE INVENTION

The present invention relates to a control circuit or loop for use in a system for electrochemically removing a coating from a part and to a system wherein multiple parts may be processed at a time with each part having a separate control loop.

Various systems for removing coatings from parts have been developed and used in recent years. In one such system, a process controller was used to control the potential of multiple parts. A practical consequence of this control architecture was that many of the parts in the load being stripped were not actually at the optimum potential for stripping during most of the run. At the beginning of the stripping process, only a few parts in the load were held at the correct potential, with the remaining parts being at potentials above or below a set point potential. In either case, the stripping process was not effective in removing coatings from the substrates. Coatings were not stripped quickly and damage was done to the substrate material of the part. To summarize, multiple parts per control loop result in damage to hardware and unacceptably long stripping times.

SUMMARY OF THE INVENTION

Accordingly, it is an object of the present invention to provide a control loop for use in a system for stripping a coating from a part.

It is a further object of the present invention to provide a control loop as above which provides an optimized potential to the part to be stripped.

The foregoing objects are attained by the control loop of the present invention.

In accordance with the present invention, a control loop to be used in a system for stripping a coating from a part, such as a turbine blade is provided. The control loop broadly comprises means for measuring a potential between the part and a reference electrode and generating a voltage output signal, means for comparing the voltage output signal to a set point voltage and for producing an output signal to be used to reduce the difference between the voltage output signal and the set point voltage, and means for supplying current to the part.

Other details of electrochemical stripping using single loop control system of the present invention, as well as other objects and advantages attendant thereto, are set forth in the following detailed description and the accompanying drawing wherein like reference numerals depict like elements.

BRIEF DESCRIPTION OF THE DRAWINGS

The FIGURE is a schematic representation of a control loop to be used in a coating stripping system in accordance with the present invention.

DETAILED DESCRIPTION OF THE PREFERRED EMBODIMENT(S)

Referring now to the FIGURE, a control loop 1 to be used in a system for stripping a coating from a part 2, such as a jet engine component, is illustrated. The control loop 1 is capable of electrochemically stripping a coating from a component in a stripping solution, such as a 5% hydrochloric acid stripping solution. The control loop 1 may be integrated into a fixture which minimizes external wiring.

In one embodiment of the present invention, the major components of the control loop 1 include an electrometer 3, an operational amplifier 4, a high current MOSFET transistor 5, an analog to digital converter 7, a digital to analog converter 8, a high resolution analog to digital converter 9, a current measurement resistor 10, a high current power supply 11 and a cathode 12. The electrometer 3 measures the potential between the part 2, which is connected as the anode, and a reference electrode 6 and outputs a voltage output signal with respect to ground. The reference electrode 6 may be an Ag/AgCl electrode or a hydrogen electrode. A suitable electrometer that may be used is a Burr Brown's INA 116 Ultra Low Input Bias Current Instrument Amplifier. An electrometer grade instrument amplifier is necessary to prevent the reference electrode 6 from becoming polarized.

The operational amplifier 4 compares the voltage output signal to a set point voltage signal and provides an output signal controlling the high current transistor 5 that will reduce the difference between the electrometer output and the set point. A Burr Brown's OPA 234 low power precision single-supply operational amplifier may be used for the operational amplifier.

The high current MOSFET transistor 5 supplies the current to the part 2. The high current MOSFET transistor 5 may be formed from an Ixis IXFN 200N07 HiPerFET™ Power MOSFET or similar device.

The control loop 1 also has a digital to analog converter 8 which provides a set point voltage to the operational amplifier 4. The digital to analog converter 8 receives a command from a microcontroller 13 to set the correct potential. The control loop 1 also has an analog to digital converter 7 that measures the voltage output from the electrometer 3. The digitized value is reported to the microcontroller 13 upon request from the microcontroller 13. The control loop 1 also has a current measuring resistor 10 having a value of approximately 0.01 ohm. The voltage drop across the current measuring resistor 10 is measured by a high precision analog to digital converter 9. The measurement of said converter is reported to the microcontroller 13 on request.

In addition to the circuit or control loop 10 described above, a HP 6680A power supply 11 may be used to provide a voltage in the range of +5 v DC at a current greater than 10 amps. The solution potential near part 2 and the current are measured and reported through the microcontroller 13 to a human machine interface 14 such as a computer or a programmed process controller. The set point is obtained from the human machine interface 14 and inputted into the microcontroller. The microcontroller communicates to the human machine interface on a communication bus such as CAN controller area network.

To remove a coating from a component such as a turbine blade, the component is first grit blasted. The blade is then inspected for corrosion or pitting. The reference electrode 6 then may be checked against an unused reference electrode. The operating set point is then set to a desired potential which depends on the type of blade being stripped. For example, for one particular type of blade, the set point may be 130 mv. The turbine blade is then electrically connected and immersed into a stripping solution, such as 5% hydrochloric acid stripping solution. Current is then applied to the blade for a desired time which again depends on the particular type of blade being cleaned. For example, for a particular type of blade, the time may be until five minutes after the second major inflection point in the current vs time curve has been reached and then stopped. Again depending on the blade being stripped, the current may be less than 0.150 amps. The blade is then disconnected and rinsed in water. Following rinsing, the blade may be blown dry with filtered air which is oil free. Thereafter, the blade may be tinted and heated at 1050–1300 degrees Fahrenheit in air for 45 minutes and inspected.

The control loop 10 of the present invention provides an optimum potential to the part to be stripped. Thus, the part may be stripped quickly without damaging the part's substrate. If multiple parts are to be stripped, each part may be provided with its own control loop 1.

It is apparent that there has been provided in accordance with the present invention an electrochemical stripping system using single loop control which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A control loop to be used in a system for stripping a coating from a part, said control loop comprising:

means for measuring a potential between the part and a reference electrode and generating a voltage output signal;

means for comparing said voltage output signal to a set point voltage and for producing an output signal to be used to reduce the difference between the voltage output signal and the set point voltage;

means for supplying current to said part;

said current supplying means comprising a transistor having a gate; and said output signal from said comparing means being supplied to the gate of said transistor.

2. A control loop according to claim 1, further comprising means for providing a set point voltage to said comparing means.

3. A control loop according to claim 2, further comprising a microcontroller for forwarding a command to said set point voltage providing means to set a potential.

4. A control loop according to claim 2, wherein said set point voltage providing means comprises a digital to analog converter.

5. A control loop according to claim 1, wherein said measuring means comprises an electrometer.

6. A control loop according to claim 5, further comprising means for measuring the voltage output from said electrometer and reporting the voltage output to a microcontroller.

7. A control loop according to claim 1, wherein said comparing means comprises an operational amplifier.

8. A control loop according to claim 1, further comprising a current measuring resistor, means for measuring the voltage drop across the current measuring resistor, and a microcontroller for receiving a signal representative of the measured voltage drop.

9. A control loop according to claim 1, further comprising a microcontroller and an interface for inputting a set point to the microcontroller.

10. A control loop to be used in a system for stripping a coating from a part, said control loop comprising:

a reference electrode;

an electrometer for measuring a potential between the part and said reference electrode and for generating a voltage output signal;

a digital to analog converter for generating a signal representative of a set point voltage;

an operation amplifier for comparing said voltage output signal and said signal representative of said set point voltage and for producing an output signal to be used to reduce the difference between the voltage output signal and the set point voltage representative signal;

a transistor having a gate, said transistor receiving said output signal at said gate, and said transistor supplying a current to said part;

a current measuring resistor;

means for measuring the voltage output from the electrometer; and a controller for receiving a signal representative of said measured voltage drop and said measured voltage output from the electrometer and for forwarding a command to the digital to analog converter to set a potential.

11. A control loop according to claim 10, wherein said reference electrode comprises a Ag/AgCl reference electrode.

12. A control loop according to claim 10, wherein said reference electrode comprises a hydrogen electrode.

13. A control loop according to claim 10, wherein said transistor comprises a high current power transistor.

14. A control loop to be used in a system for stripping a coating from a part, said control loop comprising:

means for measuring a potential between the part from which the coating is being stripped and a reference electrode and generating a voltage output signal;

means for comparing the voltage output signal to a set point voltage and for producing an output signal to be used to reduce the difference between the voltage output signal and the set point voltage;

means for supplying a current to said part from which the coating is being stripped;

said current supplying means comprising a transistor having a gate; and said output signal produced by said comparing means being supplied to said gate of said transistor.

* * * * *